US005101892A

United States Patent [19]

Takeuchi et al.

[11] Patent Number: 5,101,892

[45] Date of Patent: Apr. 7, 1992

[54] HEAT EXCHANGER

[75] Inventors: Hiroyuki Takeuchi, Kobe; Shozoh Fujii, Kakogawa, both of Japan

[73] Assignee: Kawasaki Jukogyo Kabushiki Kaisha, Hyogo, Japan

[21] Appl. No.: 697,481

[22] Filed: May 2, 1991

Related U.S. Application Data

[63] Continuation of Ser. No. 437,846, Nov. 17, 1989, abandoned.

[30] Foreign Application Priority Data

Nov. 17, 1988 [JP] Japan ..... 63-150518[U]

[51] Int. Cl.[5] ..... F28F 9/16

[52] U.S. Cl. ..... 165/158; 165/159; 165/173

[58] Field of Search ..... 165/158, 159, 81, 82, 165/83, 173, 175

[56] References Cited

U.S. PATENT DOCUMENTS

| | | | |
|---|---|---|---|
| 1,904,875 | 4/1933 | Metzgar | 165/159 |
| 1,990,251 | 2/1935 | Potter | 165/82 |
| 2,715,516 | 8/1955 | Reinold et al. | 165/159 |
| 3,540,529 | 11/1970 | Umino et al. | 165/134.1 |
| 3,769,489 | 10/1973 | Charlesworth | 165/173 |
| 3,833,055 | 9/1974 | Munz et al. | 165/158 |
| 3,973,621 | 8/1976 | Bow et al. | 165/83 |
| 4,197,907 | 4/1980 | Smith | 165/158 |
| 4,343,351 | 8/1982 | Belleli | 165/158 |
| 4,834,173 | 5/1989 | Weiss et al. | 165/159 |
| 4,943,001 | 7/1990 | Meyer | 165/173 |

*Primary Examiner*—Martin P. Schwadron
*Assistant Examiner*—L. R. Leo
*Attorney, Agent, or Firm*—Wenderoth, Lind & Ponack

[57] ABSTRACT

A heat exchanger having a plurality of tubes extending between front and rear tubesheets, baffles arranged inside the shell along a longitudinal direction of the tubes and 2 types of weld structures on respective tubesheets. Each of the tubes has an outer diameter in the range of 25.4 to 50.8 mm and the front tubesheet has a thickness less then 50 mm. The 2 types of welds comprise:

(a) a structure (Type A) in which the tubesheet is provided with a hole having an inner diameter substantially equal to that of the tube, a protruded peripheral portion formed around an outside opening of the hole and an inside stepped cutout into which the end of the tube is inserted and a weld formed; and (b) a structure (Type B) in which the tube sheet is provided with an inner tapered hole and an adjacent communicating linear small diameter hole, a tube having an end portion provided with an inside stepped cutout which is inserted into the small diameter hole, and a weld formed.

8 Claims, 6 Drawing Sheets

HEAT EXCHANGER

This application is a continuation of now abandoned application Ser. No. 07/437,846 filed on Nov. 17, 1989.

BACKGROUND OF THE INVENTION

This invention relates to a heat exchanger and, more particularly, a shell and tube heat exchanger or tubular heat exchanger for effecting a heat exchanging operation between low temperature gas and high temperature gas.

There is known a gas-gas heat exchanger, for example, a shell and tube heat exchanger, in which a low temperature gas (about 100° C.) to be fed into a dehydrogenation reactor in a styrene monomer manufacturing apparatus is heated and, simultaneously, a high temperature gas (about 500° to 600° C.) from the dehydrogenation reactor is cooled. It is generally required for the shell and tube heat exchanger of this type to be arranged in series of a heat exchanger located downstream thereof on the tube side because of the arrangement of equipment required for the process. In addition, with the heat exchanger of this type, it is also necessary to absorb the expansion difference between thermal expansions of the heat exchanger .tube (hereinafter called the "tube") and the shell due to the average metal temperature difference between the tube side and the shell side. In order to solve these problems, a conventional heat exchanger is generally constructed so that both the tube side and the shell side have one pass and a rear tubesheet is formed into a floating type or the conventional heat exchanger is constructed as a fixed tubesheet heat exchanger in which an expansion joint is arranged outside or inside the shell.

With the conventional heat exchangers of the types described above, a front tubesheet is composed of a welded attachment structure (Type D) as shown in FIG. 11 in which tube and tubesheet are welded and a rear tubesheet is composed of a welded attachment structure (Type C) as shown in FIG. 10 in which the tube and the tubesheet are welded and a metal wall of the tube is expanded towards the tubesheet. Namely, the Type D is a structure in which the end portion of the tube is inserted into an end opening of a tube hole in the tubesheet up to the end of larger diameter portion of the tube hole and then welded. The Type C is a structure in which the tube is inserted into the end opening of the tube hole in the tubesheet so that the front end of the tube protrudes from the tubesheet, the front end of the tube is welded to the tubesheet and a tubular portion of the tube inserted into the tubesheet is expanded before or after the welding operation.

The Japanese Patent Laid-open Publication No. 50-76638 discloses a heat exchanger in which a frustoconical surface is formed so that a point of a virtual cone is positioned in a tube hole of a tubesheet and in which groups of tubes inserted into the tubesheets are welded at the tube end sides.

The conventional heat exchanger assembled in the styrene monomer manufacturing apparatus of the type described above tends to cause problems in that, since the heat exchanger is generally operated under a pressure as low as possible near the atmospheric pressure, the maximum allowable pressure loss for the actual operation is extremely small. Hence, it is difficult to keep sufficiently short the distance between each two adjacent baffles on the side of the shell, resulting in the generation of flow-induced vibration of the tube. Moreover, in such a heat exchanger, the gas flow is liable to stagnate at a portion near the tubesheet on the shell side, at which paint carbon contained in the gas is liable to precipitate as carbon particles.

With the Type D structure described above, it is impossible to substantially completely eliminate the gap between the tube and the tubesheet and a small gap, even an extremely small gap, remains. For this reason, when the carbon is precipitated, the carbon particle intrudes into the gap and the carbon particle gradually grows in the gap as time elapses for a long time operation into a massive solidified carbon particle, which may press inwardly and finally deform the tube (which is a so called necking phenomenon for the tube). In an adverse case, such deformation will damage the welded portion between the tube and the tubesheet or break the tube, thereby resulting in leakage of the gas from the shell side to the tube side.

Such an adverse phenomenon is more liable to happen on the side of the front tubesheet, but may be observed on the side of the rear tubesheet. This problem is also significant, as is the problem of the flow-induced vibration of the tube described above for the conventional heat exchanger.

In addition, the tube tubesheet weld attachment structure disclosed in the Japanese Patent Laid-open Publication No. 50-76638 has been proposed for the purpose of preventing the stagnation of liquid and, for this purpose, an obtuse-angled taper is formed at the tube hole in the tubesheet. This imparts restrictions in the formation of the tubesheet, design for improving the strength, thickness of the tubesheet, pitch of the tube arrangement, etc. Accordingly, the structure of this prior art lacks wide utilization.

SUMMARY OF THE INVENTION

An object of this invention is to substantially eliminate the defects or drawbacks encountered in the prior art described above and to provide a heat exchanger provided with an improved tube - tubesheet welded attachment structure capable of substantially completely eliminating gaps between the tubes and the front and rear tubesheets and of preventing the tube and the welded portion between the tube and the tubesheets from being damaged, even in a case where carbon is precipitated near the tubesheets during the operation of the heat exchanger.

Another object of this invention is to provide a heat exchanger provided with baffles having a structure selected suitably from some applicable baffle types superior in the flow-induced vibration preventing characteristics of the tubes.

These and other objects can be achieved according to this invention by providing a heat exchanger of the type having a rear tubesheet of a floating structure type or a stationary tubesheet in which an expansion joint is disposed inside or outside of a shell of a heat exchanger to absorb an expansion difference, due to thermal expansion of a tube and the shell. The heat exchanger comprises a shell forming a body of a heat exchanger, tubesheets comprising front and rear tubesheets disposed inside the shell at portions near longitudinal ends of the shell, a plurality of tubes extending between the front and rear tubesheets, and baffles arranged inside the shell along a longitudinal direction of the heat exchanger tubes. Each of the tubes has an outer diameter in the range of 25.4 to 50.8 mm. The front tubesheet has a thickness less than 50 mm, and the tubes and the front and rear tubesheets are welded to substantially eliminate gaps therebetween. The heat exchanger of the present invention is utilized in a combination of the following welded attachment structures of: (a) a structure (Type A) in which the tubesheet is provided with a hole having an inner diameter substantially equal to that of the tube and with a protruded peripheral portion formed around an inside opening of the hole and having an outer diameter slightly larger than an outer diameter of the tube, the protruded peripheral portion having an inside stepped cutout portion in a circumferential direction thereof to form a stopper portion into which one end of the tube is inserted in abutment thereto and welding is carried out between the inserted end of the tube and the tubesheet; and (b) a structure (Type B) in which the tubesheet is provided with an inner tapered hole and a linear small diameter hole communicating at one end with a small diameter portion of the tapered hole, a tube having an end portion provided with an inside stepped cutout in a circumferential direction thereof being inserted into the small diameter hole, and welding being carried out between the inserted end of the tube and a portion of the tubesheet surrounding the small diameter hole.

In preferred embodiments, the tube and the tubesheets may be welded by adopting the combination of the welding structures of the Types A and B in the following manner.

The rear tubesheet has a thickness more than 50 mm, the tube bundle is provided with "Segmental No Tube In Window Type" baffles, or "Segmental Type" baffles, or "Double Segmental Type" baffles, the front tubesheet is welded to the tube in the form of the structure of Type B, and the rear tubesheet is welded to the tube in the form of the structure of Type A.

The three types of baffles mentioned above are defined as follows.

Segmental No Tube In Window Type (hereinafter called "NTIW Type"): each of the baffles is formed in a circular shape having a cutout portion, and the tubes are arranged only at a portion at which parts of adjacent baffles are overlapped;

Segmental Type: each of the baffles is formed in a circular shape having a cutout portion, and the tubes are arranged fully in the shell.

Double Segmental Type: each of the adjacent baffles are arranged in a combination of a circular baffle having plural cutout portions at opposite ends and the other circular baffle having a cutout portion at its center, and the tubes are arranged fully in the shell.

The rear tubesheet has a thickness less than 50 mm, the tube bundle is provided with Segmental Type baffles, or Double Segmental Type baffles, the front tubesheet is welded to the tube in the form of the structure of Type A and the rear tubesheet is welded to the heat exchanger in the form of the structure of Type B.

The rear tubesheet has a thickness less than 50 mm, the tube bundle is provided with Segmental Type baffles, or Double Segmental Type baffles, the front tubesheet is welded to the tube in the form of the structure of Type B and the rear tubesheet is welded to the tube in the form of the structure of Type A or B.

According to the invention having the characteristics described above, the tubes and the front and rear tubesheets of the heat exchanger can be welded in a suitable welding mode to substantially completely eliminate gaps between the tubesheets and the tubes. The welding with the Type A structure may be classified essentially as butt-welding of tubesheet and a tube. The welding is carried out from the inside of the tube and the completely fused penetration will be achieved at the welded portion. The welded condition has to be inspected from the outside of the tube to confirm the quality of the welded portion. The welding to the Type B structure is suitable for the welding of the tubesheet having a relatively thin thickness, less than 50 mm to the tube having an outer diameter of 25.4 to 50.8 mm, for example. The welding operation is carried out from the front side of the tubesheet with the abutting condition of the tube and the tubesheet. The welded condition will be confirmed from the front side, i.e. welding side, of the tubesheet.

Accordingly, the gaps between the front and rear tubesheets and the tubes can be substantially completely eliminated by adopting the suitable structures thereof to avoid the necking phenomenon of the tube even if carbon is precipitated near the tubesheets during the operation of the heat exchanger. The type of the baffles may be also selected suitably in accordance with the flow-induced vibration analysis of the tubes.

DESCRIPTION OF THE PREFERRED EMBODIMENTS

Preferred embodiments according to this invention will be described hereunder with reference to the accompanying drawings.

Figure 1:
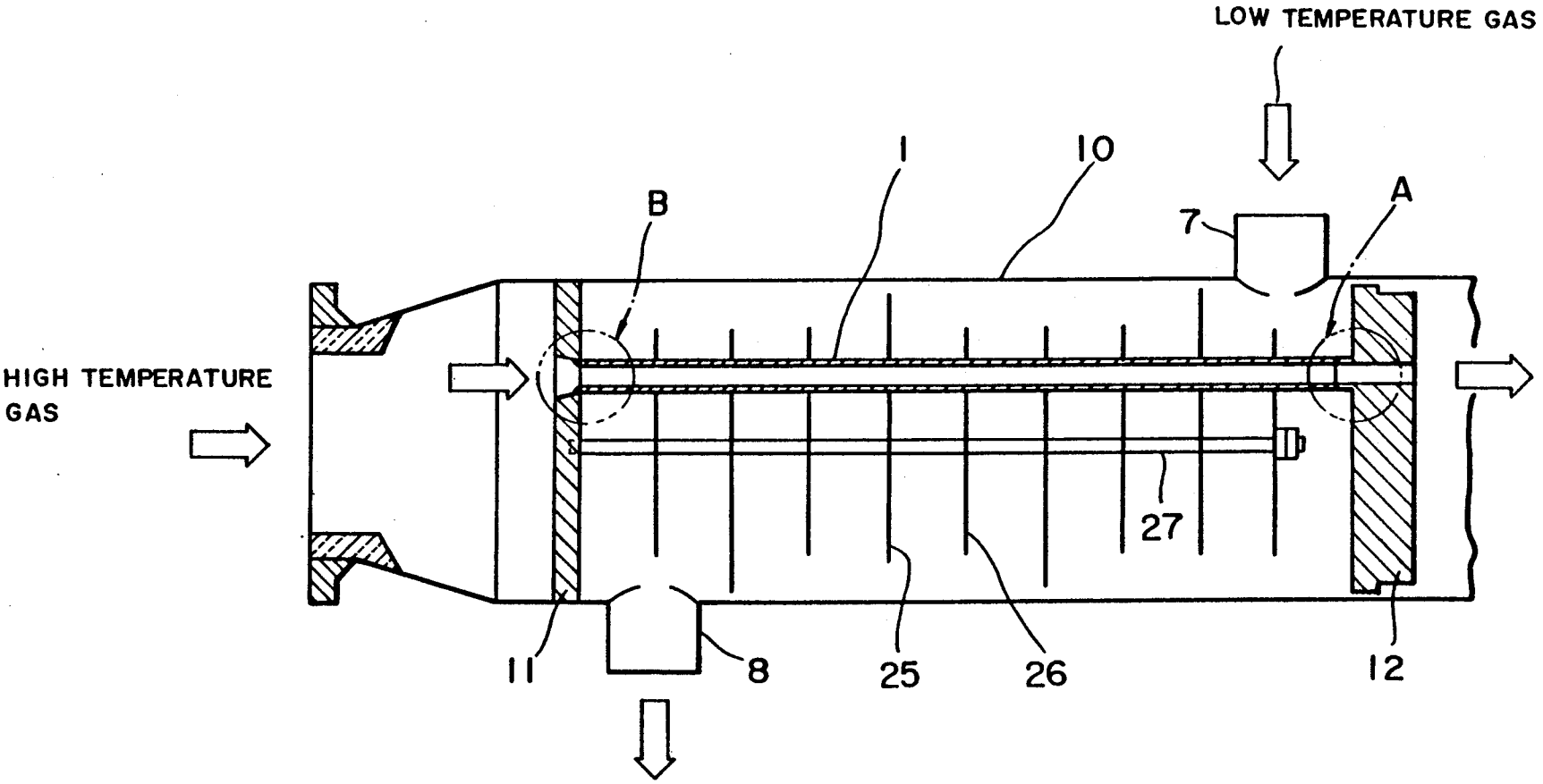
FIG. 1 is a longitudinal sectional view of one embodiment of a heat exchanger according to this invention.
Figure 9:
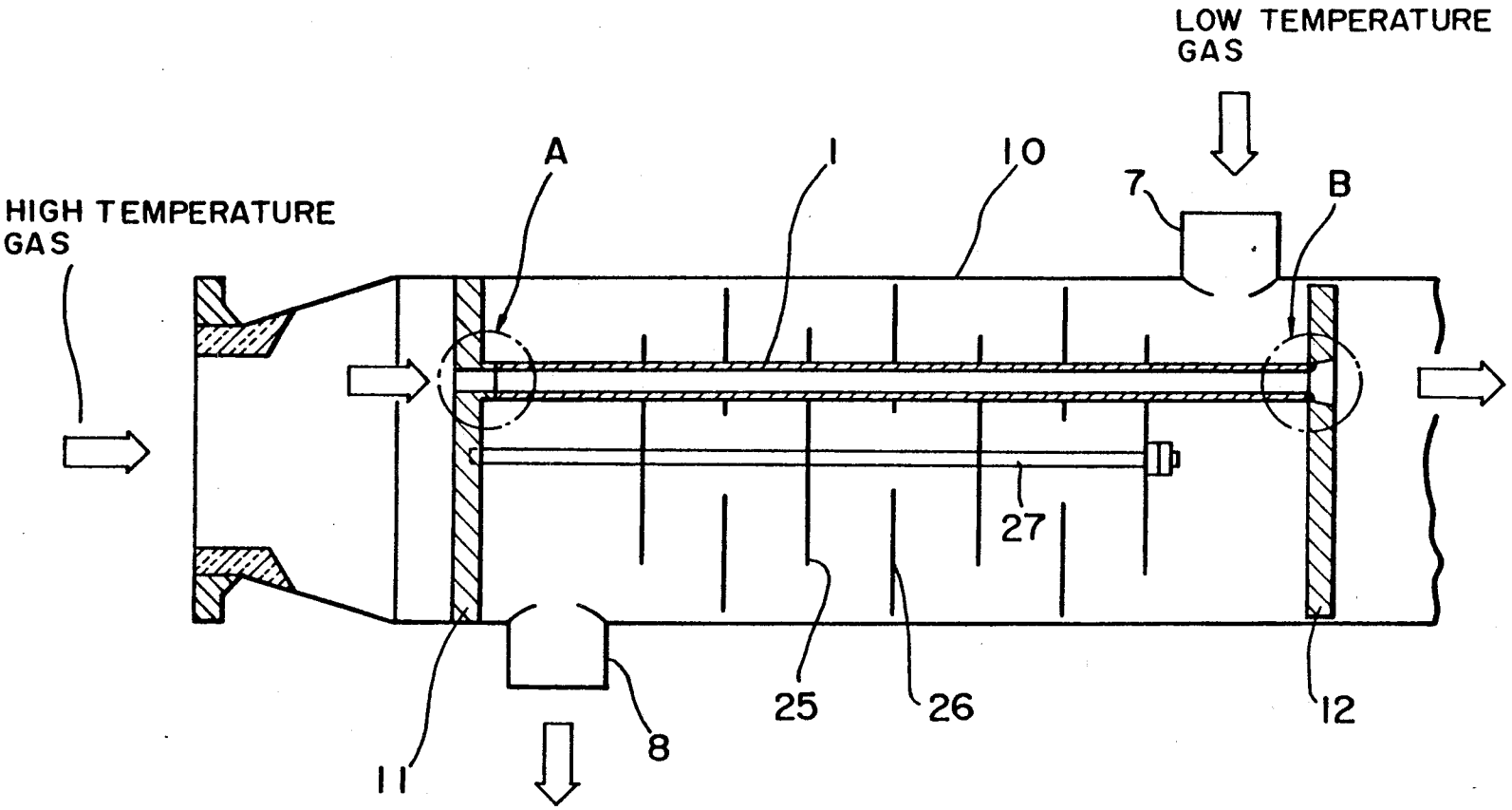
FIG. 9 is a longitudinal sectional view of another embodiment of a heat exchanger according to this invention.
Figure 10:
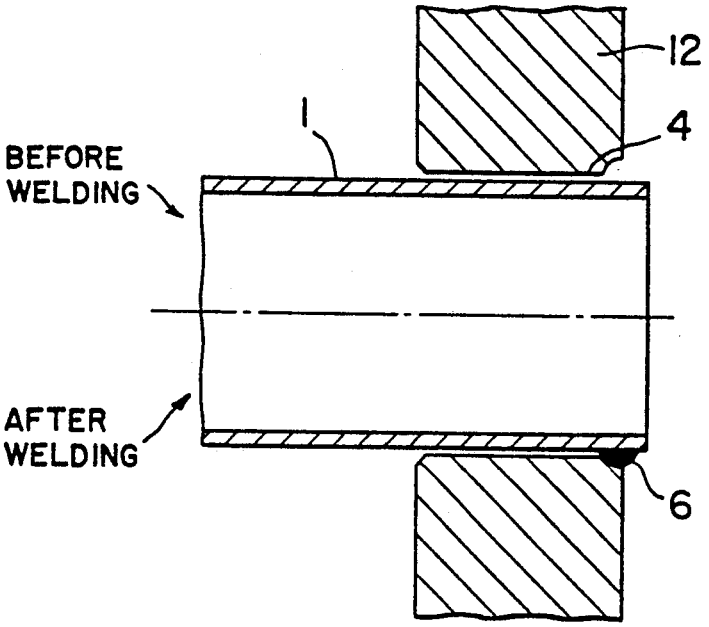
FIG. 10 PRIOR ART
FIG. 10 is a sectional view showing the welded attachment structure (Type C) of the tube and the tubesheet.
Figure 11:
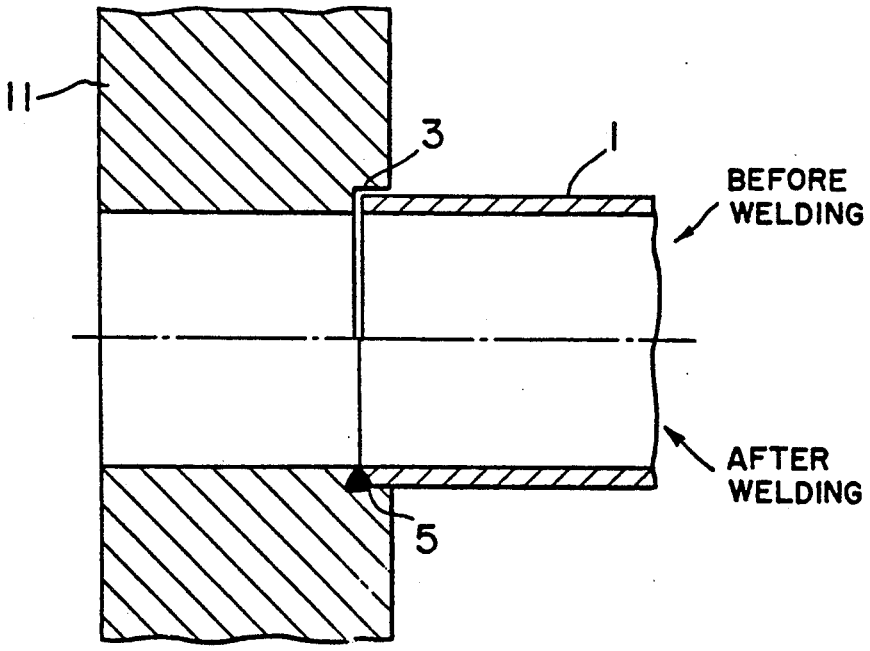
FIG. 11 PRIOR ART
FIG. 11 is a sectional view showing the welded attachment structure (Type D) of the tube and the tubesheet.
Figure 12:
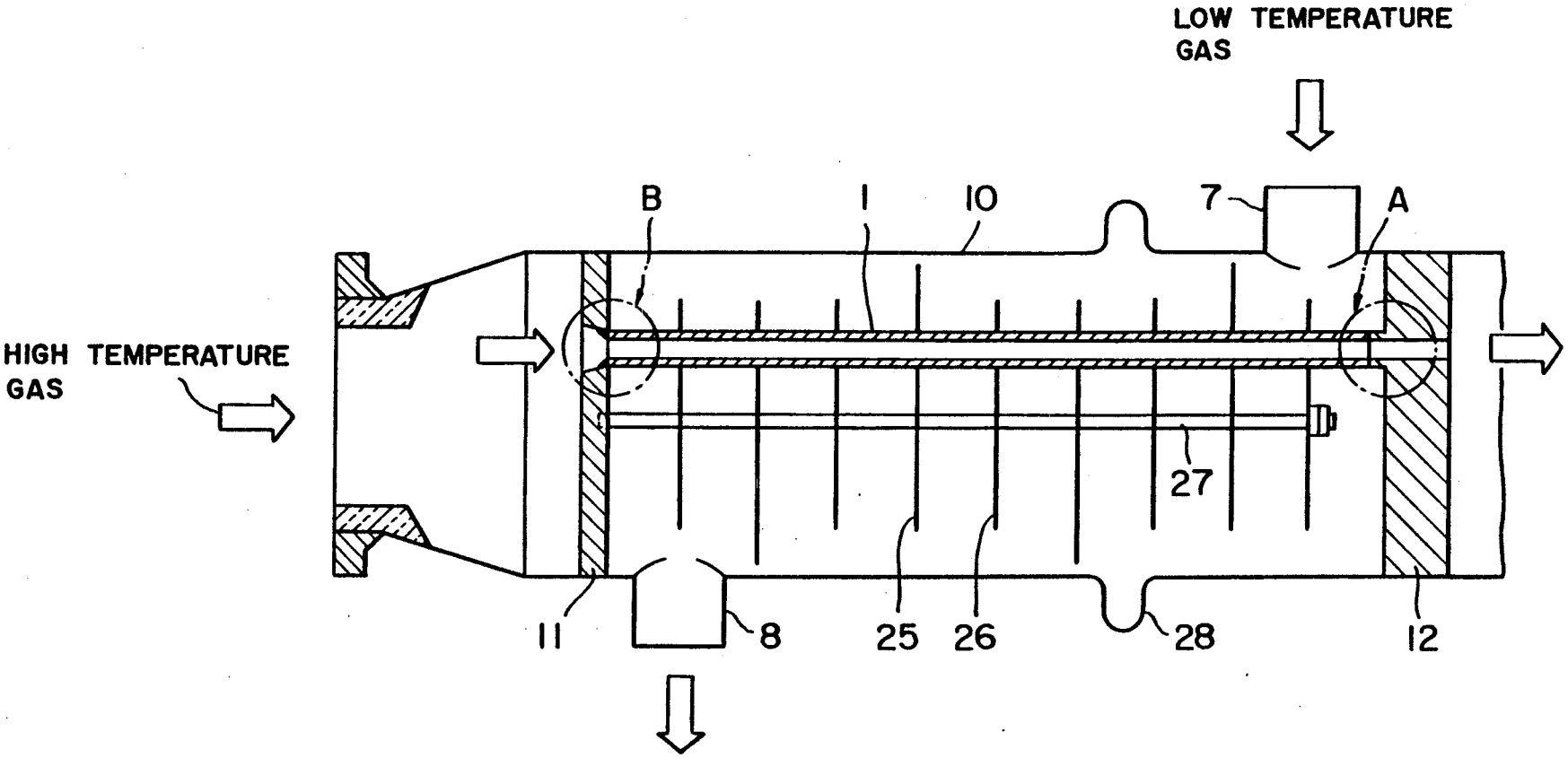
FIG. 12 is a longitudinal sectional view of further embodiment of a heat exchanger with an expansion joint according to this invention.

FIGS. 1, 9 and 12 show the preferred embodiments of the shell and tube heat exchanger according to the present invention of the type in which tubes 1 and a shell 10 are each provided with only one pass and, in order to absorb or compensate for the expansion difference due to thermal expansion of the tube 1 and the shell 10, a rear tubesheet 12 is constructed as a floating type or as a fixed tubesheet type in which an expansion joint is disposed to the outer or inner portion of the shell 10.

FIG. 1 shows a first embodiment in which a shell and tube heat exchanger having a rear tubesheet 12 is constructed to be a floating type.

The floating type rear tubesheet 12 is designed so as to have a thickness more than 50 mm with respect to a tube 1 having an outer diameter of 38.1 mm, and the rear tubesheet 12 is provided with a tube tubesheet weld attachment structure (Type A). The tube bundle is provided with baffles 25 and support plates 26. The baffles 25 are of NTIW Type and a support 26 is installed between each adjacent baffle 25 in accordance with a flow-induced vibration analysis of the tube 1. The support plates 26 have a circular shape and plural cutout portions at opposite ends thereof and are utilized together with only NTIW Type baffles. The support plates 26 have generally no effect on the thermal and hydraulic performance of a heat exchanger, but are utilized for preventing the tube 1 from the vibrating in the shell 10. A front tubesheet 11 (stationary tubesheet) is designed so as to have a thickness less than 50 mm, for example, with respect to a tube 1 and is provided with a tube tube-tubesheet weld attachment structure (Type B). High temperature gas is induced into the tube 1 as shown in FIG. 1 and low temperature gas flows into the shell 10 through an inlet nozzle 7 and flows out therefrom through an outlet nozzle 8.

Figure 2:
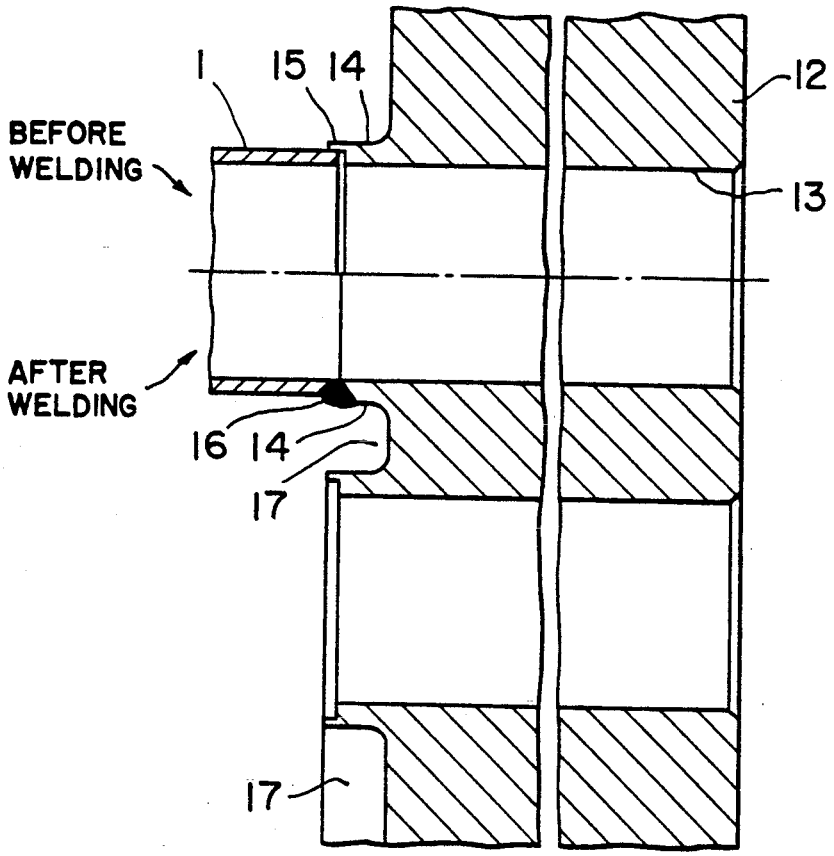
FIG. 2 is an enlarged sectional view of a portion encircled by A in FIG. 1 showing a welded attachment structure (Type A) of a tube and a tubesheet.

With reference to FIG. 2, in the structure of Type A, a hole 13 is formed in a tubesheet 12 so as to have an inner diameter equal to an inner diameter of the tube 1. A peripheral portion 14 of the tubesheet 12 having an outer diameter slightly larger than the outer diameter of the tube 1 is protruded around one end opening of the hole 13. The peripheral portion 14 is provided with inside cutout portions in a circumferential direction to form stopper portions 15 into which one end of the tube 1 is inserted in abutment thereagainst and the inserted end of the tube 1 is welded there to the tubesheet 12.

FIG. 2 shows an upper half on the central axial line of the tube 1 before the welding operation and a lower half thereof after the welding operation and reference numerals 16 and 17 designate a welded portion and a groove formed in the tubesheet 12, respectively.

Figure 3:
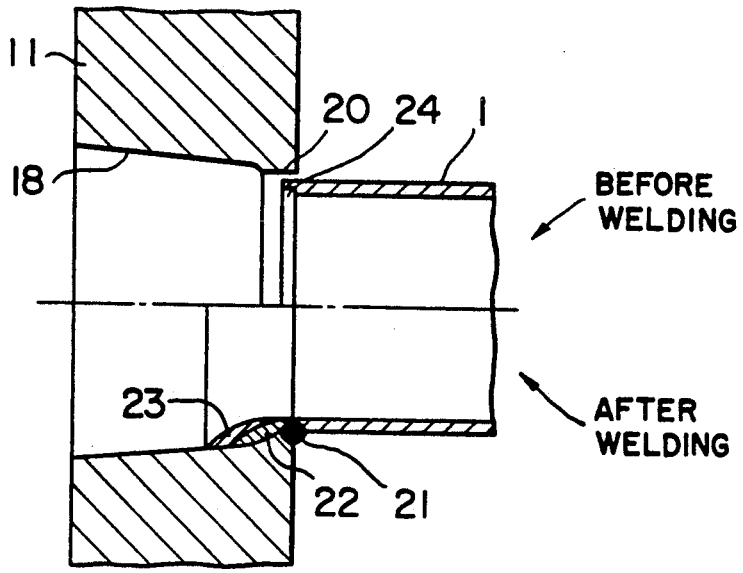
FIG. 3 is an enlarged sectional view of a portion encircled by B in FIG. 1 showing the welded attachment structure (Type B) of the tube and the tubesheet.

With reference to FIG. 3, in the structure of Type B, a tapered hole 18 and a linear smaller diameter hole 20 communicating with a tapered hole .18 at a smaller diameter portion thereof are formed in a tubesheet 11 and a tube 1 having a front end provided with an inner circumferential cutout 24 is inserted into the smaller diameter hole 20 to which the front end of the tube 1 is welded.

Figure 4:
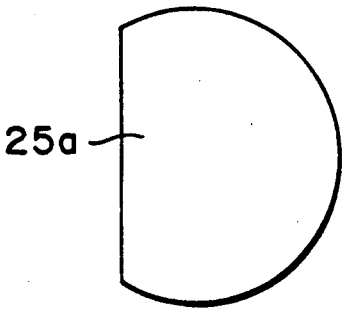
FIGS. 4 to 7 are illustrations of various types of circular baffles each having at least one cutout portion utilized for the heat exchanger of this invention.
Figure 5:
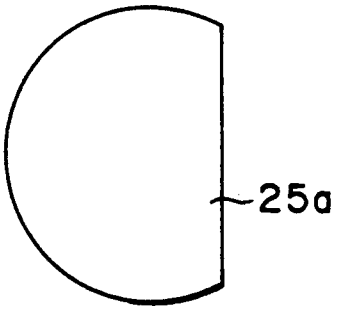
Figure 6:
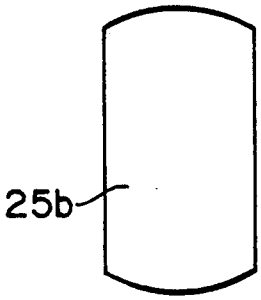
Figure 7:
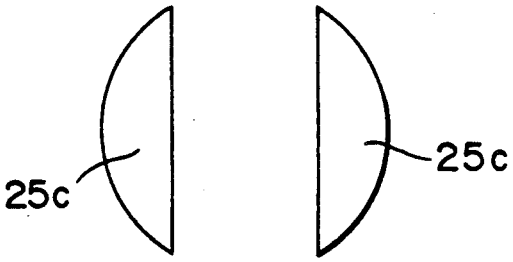
Figure 8:
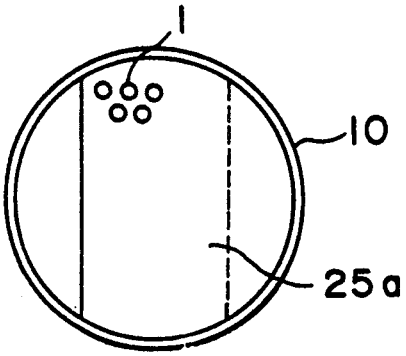
FIG. 8 is a view showing an arrangement of the circular baffle provided with a cutout portion and the tube disposed only at a portion at which parts of the adjacent baffles are overlapped.

With the first embodiment, a baffle 25 is formed in a circular section with a cutout as shown in FIG. 8 as a baffle 25*a* and the tubes 1 are arranged only at portions at which parts of adjacent baffles 25*a* are irregularly overlapped in the longitudinal direction of the shell 10 (NTIW Type baffles). The adjacent baffles 25 may be arranged in combination with other baffles 25*a* as shown in FIGS. 4 and 5 and the tubes 1 are arranged fully in the shell 10 (Segmental Type baffles), or with baffles 25*b* and 25*c* having plural cutout portions shown in FIGS. 6 and 7 (Double Segmental Type baffles) depending on the flow-induced tube vibration analysis.

With the heat exchanger of the type described above, the welding operations of the tube 1 and the tubesheets 11 and 12 in combination with the Types A and B will be performed in accordance with the following.

The front tubesheet 11 and the shell 10 are first welded in their circumferential directions and tie rods 27, baffles 25 and support plates 26 are then assembled in the shell 10. The rear tubesheet 12 is thereafter set at a predetermined position. A number of tubes 1 each having an axial length slightly longer than a predetermined length are classified into a plurality of groups, and a first group of the tubes 1 is inserted into the shell 10 through the front tubesheet 11 to carry out a prealignment with the rear tubesheet 12 before welding.

FIG. 3 shows an upper half on the central axial line of the tube 1 before the welding operation and a lower half thereof after the welding operation and reference numerals 21, 22 and 23 designate welded portions and reference numeral 24 designates a cutout portion formed in an end of the tube 1.

The welding operation of the first group of the tubes 1 is then carried out to exhibit the Type A structure and the welding result is inspected.

The inspection of the welding condition from the outside of the tubes 1 is carried out by an inspector entering from the inlet nozzle 7 on the shell side nearest the rear tubesheet 12. In case the inner diameter of the inlet nozzle 7 is small or adequate space in the shell 10 is not secured below the inlet nozzle 7, it will be required to temporarily remove a part of the shell 10, which is generally divided into a plurality of sections in the longitudinal direction thereof, located near the rear tubesheet 12. In case any fault is found in the course of inspection of the welded portion, rearrangement of the tubes 1 will be required. All of the groups of the tubes 1 are welded in substantially the same manner as that described above.

After the tubes 1 have been welded and attached to the rear tubesheet 12, the front ends extending over the front tubesheet side of the shell 10 are cut by a cutter so as to adjust the longitudinal length thereof and bevel the end of each tube 1. The front tubesheet 11 is then welded to exhibit the Type B structure, thereby securing the tubes 1 to the front tubesheet 11. The welded condition is inspected from the front side of the front tubesheet 11.

FIG. 9 shows a second embodiment in which a shell and tube heat exchanger having a rear tubesheet 12 is constructed to be a floating type.

The floating type rear tubesheet 12 is designed so as to have a thickness less than 50 mm with respect to a tube 1 having an outer diameter of 38.1 mm. The rear tubesheet 12 is provided with a tube - tubesheet weld attachment structure (Type B). The baffles 25 are arranged in a combination of the baffles 25*b* and 25*c* having plural cutout portions shown in FIGS. 6 and 7 (Double Segment Type baffles) in accordance with the flow-induced vibration analysis of the tube 1. A front tubesheet 11 (fixed tubesheet) is designed so as to have a thickness also less than 50 mm, for example, with respect to a tube 1 and is provided with a tube - tubesheet welding attachment structure (Type A).

The dimensions and the shapes of the tube 1 at portions to be welded to the front and rear tubesheets 11 and 12 are substantially the same as those described with reference to the first embodiment in conjunction with FIGS. 2 and 3.

With the second embodiment, the adjacent baffles 25 may be arranged in a combination of the baffles 25*a* shown in FIGS. 4 and 5 and the tubes 1 arranged fully in the shell 10 (Segmental Type baffles), depending on the flow-induced tube vibration analysis.

FIG. 12 shows a third embodiment in which an expansion joint 28 is arranged outside the shell 10 so as to construct a fixed tubesheet type.

With the heat exchanger of the type described above, the welding operations of the tube 1 and the tubesheets 11 and 12 of Types A and B will be performed in accordance with the manner substantially identical to that described with reference to the first embodiment.

In the welding attachment operation, it is necessary to first carry out the welding operation to exhibit the Type A structure and next carry out the longitudinal length adjustment of the tubes 1 on the side at which the welding operation is carried out to exhibit the Type B structure. The bevels are then formed on the ends of the tubes 1, and the tube ends are welded.

After the welding operation has been completed, the welded portion is inspected in substantially the same manner as described hereinbefore with reference to the first embodiment.

In the course of inspection of the welding condition from the outside of the tubes 1, in case the inner diameter of the outlet nozzle 8 is small or an adequate space is not secured below the outlet nozzle 8 or the shell side nearest the front tubesheet 11, the peripheral welding may be carried out after the inspection. In such a case, the shell 10 is temporarily shifted rearwardly and the inspection is therefore made from the outside of the tubes 1.

According to this embodiment, it may be possible to carry out the welding operation to exhibit the Type B structure at the front tubesheet 11 and to exhibit the Type A structure at the rear tubesheet 12, as described with reference to the first embodiment, or also possible to carry out the welding operation to exhibit the Type B structures at both the front and rear tubesheets 11 and 12. With the welding operation on the tubes, 1 and the tubesheets 11 and 12 in a combination of weld Types A and B, the welding operation is carried out by the same manner as that described with reference to the first embodiment. With the welding operation in a combination of the weld Types A and B, the welding operation will be performed first to the front tubesheet 11 and next to the rear tubesheet 12, or vice versa, without problem to obtain substantially the same welding results.

According to this invention, the gaps between the front and rear tubesheets and the tubes can be substantially completely eliminated by adopting the suitable welding modes and the baffle type may be also selected suitably in accordance with the flow-induced vibration analysis of the tubes.

What is claimed is:

1. A heat exchanger, comprising:

a shell forming a body of the heat exchanger;

a rear tubesheet in said shell at one longitudinal end thereof and a front tubesheet at an opposite longitudinal end thereof;

a plurality of tubes extending between said front and rear tubesheets;

a plurality of baffles disposed inside said shell along the longitudinal direction of said tubes;

means for absorbing expansion differences due to relative thermal expansion between said plurality of tubes and said front and rear tubesheets; and means for preventing said tubes from being damaged due to vibration of said tubes induced by a flow of gas on the inner surface of said shell;

wherein said front tubesheet is welded to said shell and is welded to each tube of said plurality of tubes by a first weld structure, said first weld structure including a hole in said front tubesheet having an inner diameter substantially equal to the inner diameter of said tube, a protruding peripheral portion disposed along and around an end of said hole in said front tubesheet having an outer diameter larger than the outer diameter of said tube, said protruding peripheral portion further having a circumferential inside stepped cutout portion having a stopper portion extending from the inner diameter of said hole to a portion thereof having the outer diameter thereof larger than the outer diameter of said tube, said tube having an end thereof inserted in abutment with said stopper portion, and a weld welded between the end of said tube and said protruding peripheral portion; and wherein said rear tubesheet is welded to each tube of said plurality of tubes by a second weld structure, said second weld structure including a tapering inner hole in said rear tubesheet having a small diameter end, a constant diameter hole in said rear tubesheet in communication with said small diameter end of said tapering inner hole, said end portion of said tube having a circumferential inside stepped cutout portion inserted into said constant diameter hole, and a weld welded between said inside stepped cutout portion of said tube and said rear tube sheet at said constant diameter hole.

2. The heat exchanger as set forth in claim 1, wherein said means for absorbing expansion differences comprises said rear tube sheet being linearly moveably mounted in said shell.

3. The exchanger as set forth in claim 1, wherein said inside stepped cutout portion extends into said constant diameter hole to a point therein spaced from said small diameter end of said tapering inner hole.

4. The heat exchanger as set forth in claim 1, wherein said means for preventing said tubes from being damaged comprises said baffles being disposed inside said shell in an NTIW baffle arrangement.

5. A heat exchanger, comprising:

a shell forming a body of the heat exchanger;

a rear tubesheet in said shell at one longitudinal end thereof and a front tubesheet at an opposite longitudinal end thereof;

a plurality of tubes extending between said front and rear tubesheets;

a plurality of baffles disposed inside said shell along the longitudinal direction of said tubes; and means for absorbing expansion differences due to relative thermal expansion between said plurality of tubes and said front and rear tubesheets;

wherein said front tubesheet is welded to each tube of said plurality of tubes by a first weld structure, said first weld structure including a tapering inner hole in said front tubesheet having a small diameter end, a constant diameter hole in said front tubesheet in communication with said small diameter end of said tapering inner hole, said end portion of said tube having a circumferential inside stepped cutout portion inserted into said constant diameter hole, and a weld welded between said inside stepped cutout portion of said tube and said front tubesheet at said constant diameter hole;

wherein said rear tubesheet is welded to each of said plurality of tubes by a second weld structure, said second weld structure including a hole in said front tubesheet having an inner diameter substantially equal to the inner diameter of said tube, a protruding peripheral portion disposed along and around an end of said hole in said front tubesheet having an outer diameter larger than the outer diameter of said tube, said protruding peripheral portion further having a circumferential inside stepped cutout portion having a stopper portion extending from the inner diameter of said hole to a portion thereof having the outer diameter thereof larger than the outer diameter of said tube, said tube having an end thereof inserted in abutment with said stopper portion, and a weld welded between the end of said tube and said protruding peripheral portion; and wherein said means for absorbing expansion differences comprises said rear tube sheet being linearly moveably mounted in said shell.

6. The exchanger as set forth in claim 5, wherein said inside stepped cutout portion extends into said constant diameter hole to a point therein spaced from said small diameter end of said tapering inner hole.

7. A heat exchanger, comprising:

a shell forming a body of the heat exchanger;

a rear tubesheet in said shell at one longitudinal end thereof and a front tubesheet at an opposite longitudinal end thereof;

a plurality of tubes extending between said front and rear tubesheets;

a plurality of baffles disposed inside said shell along the longitudinal direction of said tubes;

means for absorbing expansion differences due to relative thermal expansion between said plurality of tubes and said front and rear tubesheets; and means for preventing said tubes from being damaged due to vibration of said tubes induced by a flow of gas on the inner surface of said shell;

wherein said front tubesheet is welded to said shell and is welded to each tube of said plurality of tubes by a first weld structure, said first weld structure including a tapering inner hole in said front tubesheet having a small diameter end, a constant diameter hole in said front tubesheet in communication with said small diameter end of said tapering inner hole, said end portion of said tube having a circumferential inside stepped cutout portion inserted into said constant diameter hole, and a weld welded between said inside stepped cutout portion of said tube and said front tubesheet at said constant diameter hole; and wherein said rear tubesheet is welded to each of said plurality of tubes by a second weld structure, said second weld structure including a tapering inner hole in said rear tubesheet having a small diameter end, a constant diameter hole in said rear tubesheet in communication with said small diameter end of said tapering inner hole, said end portion of said tube having a circumferential inside stepped cutout portion inserted into said constant diameter hole, and a weld welded between said inside stepped cutout portion of said tube and said rear tubesheet at said constant diameter hole.

8. The heat exchanger as set forth in claim 7, wherein said means for preventing said tubes from being damaged comprises said baffles being disposed inside said shell in an NTIW baffle arrangement.

* * * * *